United States Patent [19]

Fujiwara

[11] Patent Number: 4,712,331

[45] Date of Patent: Dec. 15, 1987

[54] DOOR

[75] Inventor: Kenichi Fujiwara, Itami, Japan

[73] Assignee: Hardglass Industry Co., Ltd., Hyogo, Japan

[21] Appl. No.: 56,349

[22] Filed: May 27, 1987

Related U.S. Application Data

[63] Continuation of Ser. No. 812,978, Dec. 24, 1985, abandoned.

[30] Foreign Application Priority Data

Dec. 26, 1984 [JP] Japan ..... 59-197161[U]

[51] Int. Cl.[4] ..... E05B 7/16

[52] U.S. Cl. ..... 49/488; 49/489

[58] Field of Search ..... 49/475, 488, 489, 490, 49/492, 495; 248/221.4

[56] References Cited

U.S. PATENT DOCUMENTS

| | | | |
|---|---|---|---|
| 2,024,192 | 12/1935 | Verhagen | 49/488 |
| 2,949,651 | 8/1960 | Hill | 49/488 |
| 4,034,511 | 7/1977 | Bursk | 49/488 |
| 4,224,974 | 9/1980 | Anderson et al. | 248/221.4 |
| 4,510,715 | 4/1985 | Giguere | 49/488 |

FOREIGN PATENT DOCUMENTS

| | | | |
|---|---|---|---|
| 2511331 | 9/1976 | Fed. Rep. of Germany | 49/488 |
| 2622152 | 11/1977 | Fed. Rep. of Germany | 49/488 |
| 1348378 | 12/1965 | France | 49/475 |
| 894501 | 4/1962 | United Kingdom | 49/488 |

*Primary Examiner*—Peter A. Aschenbrenner
*Assistant Examiner*—Gerald A. Anderson
*Attorney, Agent, or Firm*—Stephen G. Rudisill

[57] ABSTRACT

The door comprising a door main body, and an air shielding member attached to at least one of both side edges in the vertical direction and both side edges in the lateral direction of the door main body, in which the air shielding member is adapted to shield the exit/entrance of airs through the gaps between the door main body and surfaces opposing thereto and comprises an engaging member for engagement with the door main body and a shielding member outwardly protruding side way from the door main body.

3 Claims, 2 Drawing Figures

DOOR

This is a continuation of application Ser. No. 812,978 filed on Dec. 24, 1985, now abandoned.

BACKGROUND OF THE INVENTION

1. Field of the Invention

This invention concerns a door of a sliding or rotating system.

2. Description of the Prior Art

Heretofore, doors have been opened and closed, for example, by a sliding or rotating system and a gap of about 10 mm has generally disposed between the lower portion of the door and the floor surface for the smooth opening and closing operations. Gaps have also been disposed on both right and left sides, as well as upper side of the door for the smooth opening and closing operations. Therefore, heat escapes from the inside to the outside of the room, or cold air intrudes into the room through the gaps when the room is being warmed. During cooling of the room, on the contrary, heat may intrude from outside to the inside of the room, or cold air in the room escapes therefrom to cause energy loss. Furthermore, there is an additional problem that dust tends to intrude from the outside to the inside of the room.

SUMMARY OF THE INVENTION

The object of this invention is to provide an improved door capable of preventing warm or cold air from leaving out of or entering into the room through the gaps between the door and the floor, wall surface, etc.

In order to attain the foregoing object, this invention comprises a door main body and an air shielding member attached at least to one of both side edges in the vertical direction and both side edges in the lateral direction of the door main body, in which the airs shielding member is adapted to shield the exit/entrance of airs between the door main body and the surface opposing thereto and comprises an engaging member for engagement with the door main body and a shielding member protruding outwardly from the door main body to the side way. The door main body includes a pair of longitudinally extending and outwardly protruding side plates which are parallel to each other, and each of which has an engaging groove on its inner surface. The engaging member has a longitudinally extending flat plate portion made of a rigid synthetic resin and is integrally formed with a pair of longitudinally extending attaching plates which protrude parallel to each other and are spaced for direct insertion between the side plates. The attaching plates each have a longitudinally extending holding protrusion for positive engagement with a respective one of the grooves in the side plates of the door main body.

Other objects of this invention will become clearer by understanding the embodiments to be explained hereinafter and described in the appended claims. Various advantages not mentioned in the specification will be obviously apparent to those skilled in the art upon practicing this invention.

DETAILED DESCRIPTION OF THE PREFERRED EMBODIMENTS

Figure 1:
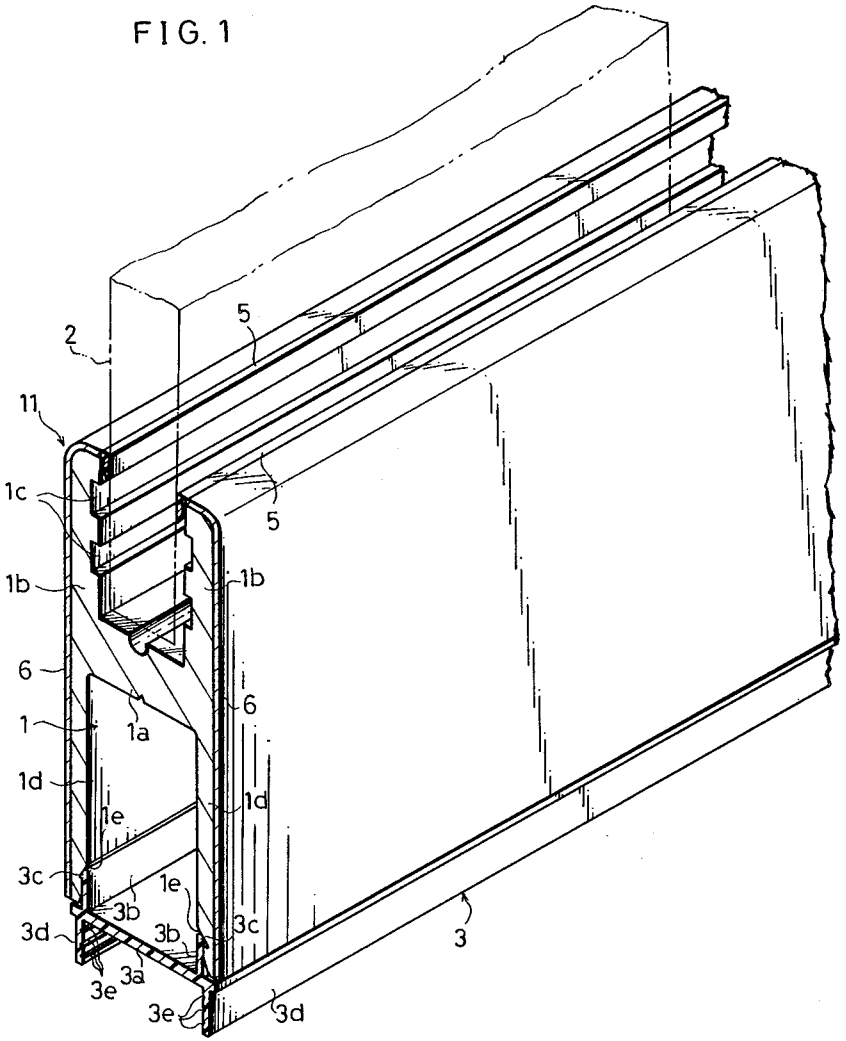
FIG. 1 is a partially cut away perspective view of a door as an embodiment of this invention.
Figure 2:
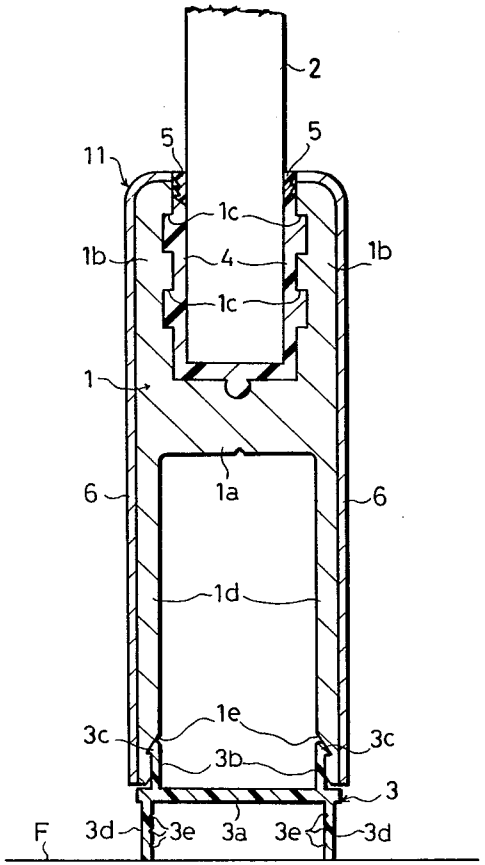
FIG. 2 is a side elevational view of FIG. 1.

One example as an embodiment of this invention will now be described referring to the drawings.

A lower frame 1 made of extruded aluminum material of a door main body 11 has a H-shaped transversal cross section. The lower frame 1 has a mounting substrate 1*a* secured to the lower end face of a glass pane 2 by means of an adhesive 4 and a pair of vertical side plates 1*b* integrally formed in parallel with each other at the upper face on both lateral side edges of the mounting substrate and adhered to the side faces of the glass pane 2. The lower edge of the glass pane 2 is secured to the inner side faces of the mounting substrate 1*a* and both of the vertical side plates 1*b* by means of the adhesive 4, and a pair of beats 5 are fitted to the upper end edge of the vertical substrate 1*b*. Grooves 1*c* extended in the longitudinal direction are engraved at the two positions on the inner side of each of the vertical side plates 1*b* so as to increase the area of contact with the glass pane 2, thereby enhancing the bonding strength. Further, a pair of suspended side plates 1*d* are protruded in parallel with each other to the lower surfaces on both lateral side edges of the lower frame 1. Engaging grooves 1*e* are respectively disposed in the longitudinal direction to the lower portion of each of the suspending side plates 1*d* for engagement with an air shielding member 3 described later, and the inner corners at the lower end edges on both of the suspended side plates 1*d* are chamferred.

The lower frame 1 is covered at both of the outer side faces thereof with a pair of decorative plates 6 made of stainless steels.

The air shielding member 3 has an H-shaped transversal cross section and comprises a flat plate 3*a* made of rigid synthetic resin, a pair of engaging plates 3*b* erected integrally and in parallel with each other on both of the right and left side edges at the upper surface of the flat plate 3*a*, and a pair of shielding plates 3*d* made of soft synthetic resin and suspended integrally and in parallel with each other on both of right and left side edges at the lower surface of the flat plate 3*a*. Both of the engaging plates 3*b* have engaging protrusions 3*c* formed on the outside of the upper end edges thereof for engagement with both of the engaging grooves 1*e*. The inner surfaces for the suspended side plates 1*d* and the engaging plates 3*b* are made coplanar with each other. Further, separating grooves 3*e* extended in the longitudinal directions are engraved each by three to the inner side faces of both of the shielding plates 3*d*. The separating grooves 3*e* enable a person to simply separate an unnecessary portion of the shielding plates 3*d* thereby permitting size adjustment if the lower end of the shielding plates 3*d* has an excessive length abutting against floor surfaces.

The operation of the door having thus been constituted will now be described.

Both of the engaging protrusions 3*c* of the air shielding member 3 are fitted into both of the engaging grooves 1*e* of the lower frame 1. In this case, if the lower end of the shielding plates 3*d* are too long to just abut against the floor surface F, an excess length is separated along the separating grooves 3*e* such that the shielding plates 3*d* may suitably be abutted against the floor surface F. In this way, since there can be attained a soft contact between the lower end of the shielding plates 3*d* and the floor surface F and the shielding plates 3*d* are made of soft and flexible material, the door can be opened or closed smoothly with a small operating force. The gap between the floor surface F and the door can substantially be eliminated by the air shielding member 3, by which exit/intrusion of air out of and into the room can be prevented. Furthermore, intrusion of dust from outside to the inside of the room can also be prevented.

This invention is no way limited to the above-mentioned embodiment but can also be practiced as described below.

(1) Although the air shielding member 3 is attached to the lower frame 1 of the door in the foregoing embodiment, the air shielding member 3 may be attached, in addition to the lower frame 1 of the door, to the upper frame or both of the left and right side frames of the door.

(2) Although the separating grooves 3*e* are engraved to the inside of the shielding plates 3*d* in the above-mentioned embodiment, they may be engraved to the outside or both of the inside and outside.

(3) The air shielding member 3 in the above-mentioned embodiment may also be used in a sliding type door.

As has been described above specifically, this invention can provide excellent effects of eliminating gaps between the air shielding member and the floor, wall surfaces, etc. thereby preventing exit and/or intrusion of air and dust into the room, as well as improving the heat insulating and dust prooving effects.

It will be apparent that various different embodiments can be constituted within a broad range without departing the spirit and the scope of this invention and, accordingly, this invention is in no way restricted to specific embodiments thereof. The intention is to cover all alternatives, modifications and equivalents of the invention as defined by the appended claims.

What is claimed is:

1. A door comprising:

a door main body (11) including a pair of longitudinally extending side plates (1*d*) which outwardly protrude in parallel spaced relation with respect to each other from at least one side edge of said door, each of said side plates having an engaging groove (1*e*) on its inner side surface, the engaging grooves extending in the longitudinal direction along the length of said side plates; and an air shielding member (3) attached to said side plates of said door main body, said air shielding member comprising a resiliently deformable flat plate portion (3*a*) made of a rigid synthetic resin and extending in the longitudinal direction along each of the protruding surfaces of said side plates, a pair of attaching plates (3*b*) disposed between said side plates and protruding inwardly in parallel spaced relation with respect to each other from respective longitudinally extending side edges of said flat plate portion with the outside surfaces of said attaching plates maintained in close contact with respective inside surfaces of said side plates, each of said attaching plates having a holding protrusion (3*c*) extending in the longitudinal direction along the length of said attaching plates for locking engagement with a respective one of said engaging grooves of said side plates, and a pair of shielding plates (3*d*) made of a soft synthetic resin and protruding outwardly in parallel spaced relation with respect to each other from respective longitudinally extending side edges of said flat plate portion, said air shielding member adapted to be directly fitted into shielding engagement with said door main body by positioning said longitudinally extending holding protrusions (3*c*) against the longitudinally extending side plates (1*d*) and pushing the shielding member inwardly while resiliently deforming said flat plate portion (3*a*) and said attaching plates (3*b*) until both the protrusions (3*c*) are lockingly engaged with respective ones of said engaging grooves (1*e*).

2. A door comprising:

a door main body (11) including a pair of longitudinally extending side plates (1*d*) which outwardly protrude in parallel spaced relation with respect to each other from at least one side edge of said door, each of said side plates having an engaging groove (1*e*) on its inner side surface, the engaging grooves extending in the longitudinal direction along the length of said side plates; and an air shielding member (3) attached to said side plates of said door main body, said air shielding member comprising a resiliently deformable flat plate portion (3*a*) made of a rigid synthetic resin and extending in the longitudinal direction along each of the protruding surfaces of said side plates, a pair of attaching plates (3*b*) disposed between said side plates and protruding inwardly in parallel spaced relation with respect to each other from respective longitudinally extending side edges of said flat plate portion with the outside surfaces of said attaching plates maintained in close contact with respective inside surfaces of said side plates, each of said attaching plates having a holding protrusion (3*c*) extending in the longitudinal direction along the length of said attaching plates for locking engagement with a respective one of said engaging grooves of said plates, and a pair of shielding plates (3*d*) made of a soft synthetic resin and protruding outwardly in parallel spaced relation with respect to each other from respective longitudinally extending side edges of said flat plates portion, wherein both of said shielding plates have a plurality of separating grooves (3*e*) for adjusting the outward protruding length of said shielding plates, said separating grooves extending in parallel spaced relation with respect to each other along the longitudinal direction of the shielding plates, said air shielding member adapted to be directly fitted into shielding engagement with said door main body by positioning said longitudinally extending holding protrusions (3*c*) against the longitudinally extending side plates (1*d*) and pushing the shielding member inwardly while resiliently deforming said flat plate portion (3*a*) and said attaching plates (3*b*) until both the protrusions (3*c*) are lockingly engaged with respective ones of said engaging grooves (1*e*).

3. A door comprising:

a door main body (11) including a pair of longitudinally extending side plates (1*d*) which outwardly protrude in parallel spaced relation with respect to each other from at least one side edge of said door, each of said side plates having an engaging groove (1*e*) on its inner side surface, the engaging grooves extending in the longitudinal direction along the length of said side plates; and an air shielding member (3) attached to said side plates of said door main body, said air shielding member comprising a resiliently deformable flat plates portion (3*a*) made of a rigid along each of the protruding surfaces of said side plates, a pair of attaching plates (3*b*) disposed between said side plates and protruding inwardly in parallel spaced relation with respect to each other from respective longitudinally extending side edges of said flat plate portion with the outside surfaces of said attaching plates maintained in close contact with respective inside surfaces of said side plates, each of said attaching plates having a holding protrusion (3*c*) extending in the longitudinal direction along the length of said attaching plates for locking engagement with a respective one of said engaging grooves of said side plates, and a pair of shielding plates (3*d*) made of a soft synthetic resin and protruding outwardly in parallel spaced relation with respect to each other from respective longitudinally extending side edges of said flat plate portion, wherein both of said shielding plates have a plurality of separating grooves (3*e*) for adjusting the outward protruding length of said shielding plates, said separating grooves extend in parallel spaced relation with respect to each other along the longitudinal direction of the shielding plates, said separating grooves are disposed on the inside spaced surfaces of said shielding plates, and wherein the outwardly protruding edge portions of said side plates have chamferred inside corners, said air shielding member adapted to be directly fitted into shielding engagement with said door main body by positioning said longitudinally extending holding protrusions (3*c*) against the longitudinally extending side plates (1*d*) and pushing the shielding member inwardly while resiliently deforming said flat plate portion (3*a*) and said attaching plates (3*b*) until both the protrusions (3*c*) are lockingly engaged with respective ones of said engaging grooves (1*e*).

* * * * *